US006547956B1

(12) United States Patent
Mukherjee et al.

(10) Patent No.: US 6,547,956 B1
(45) Date of Patent: Apr. 15, 2003

(54) HYDROCRACKING OF VACUUM GAS AND OTHER OILS USING A POST-TREATMENT REACTIVE DISTILLATION SYSTEM

(75) Inventors: Ujjal Kumar Mukherjee, Montclair, NJ (US); Wai Seung Louie, Brooklyn, NY (US)

(73) Assignee: ABB Lummus Global Inc., Bloomfield, NJ (US)

( * ) Notice: Subject to any disclaimer, the term of this patent is extended or adjusted under 35 U.S.C. 154(b) by 0 days.

(21) Appl. No.: 09/557,022

(22) Filed: Apr. 20, 2000

(51) Int. Cl.[7] ..... C10G 65/02; C10G 65/12

(52) U.S. Cl. ..... 208/58; 208/59; 208/89; 208/97; 208/210

(58) Field of Search ..... 208/58, 59, 89, 208/97, 210

(56) References Cited

U.S. PATENT DOCUMENTS 3,119,765 A * 1/1964 Corneil et al. ..... 208/210
3,147,210 A 9/1964 Hass et al. ..... 208/210
5,183,556 A 2/1993 Reilly et al. ..... 208/57
5,779,883 A * 7/1998 Hearn et al. ..... 203/28
5,961,815 A * 10/1999 Hickey et al. ..... 208/108
6,224,747 B1 * 5/2001 Cash et al. ..... 208/107
6,224,749 B1 * 5/2001 Gupta et al. ..... 208/210
6,299,759 B1 * 10/2001 Bradway et al. ..... 208/108
6,338,793 B1 * 1/2002 Putman ..... 203/28
2001/0042699 A1 * 11/2001 Cash et al. ..... 208/58

* cited by examiner

*Primary Examiner*—Walter D. Griffin
(74) *Attorney, Agent, or Firm*—Alix, Yale & Ristas, LLP

(57) ABSTRACT

The invention relates to a hydrotreating and hydrocracking process for various oils nominally boiling between 600 and 1500° F. to produce diesel oil and lighter materials. The process includes a first hydrogenation reaction in the presence of multiple hydrogenation catalyst beds which is limited to the hydrogenation level needed for the removal of sulfur and nitrogen and for aromatic saturation and to produce an effluent of both hydrocracked oil and uncracked heavy oil. The effluent is then flashed to produce hydrocracked oil vapors and liquid uncracked heavy oil. The hydrocracked oil fraction is further hydrotreated by catalytic distillation in a post-treatment reactor to give the final product quality while the liquid uncracked heavy oil bypasses the post-treatment reactor. The process significantly reduces hydrogen consumption and reduces the overall reactor and catalyst volumes for a given level of performance.

4 Claims, 1 Drawing Sheet

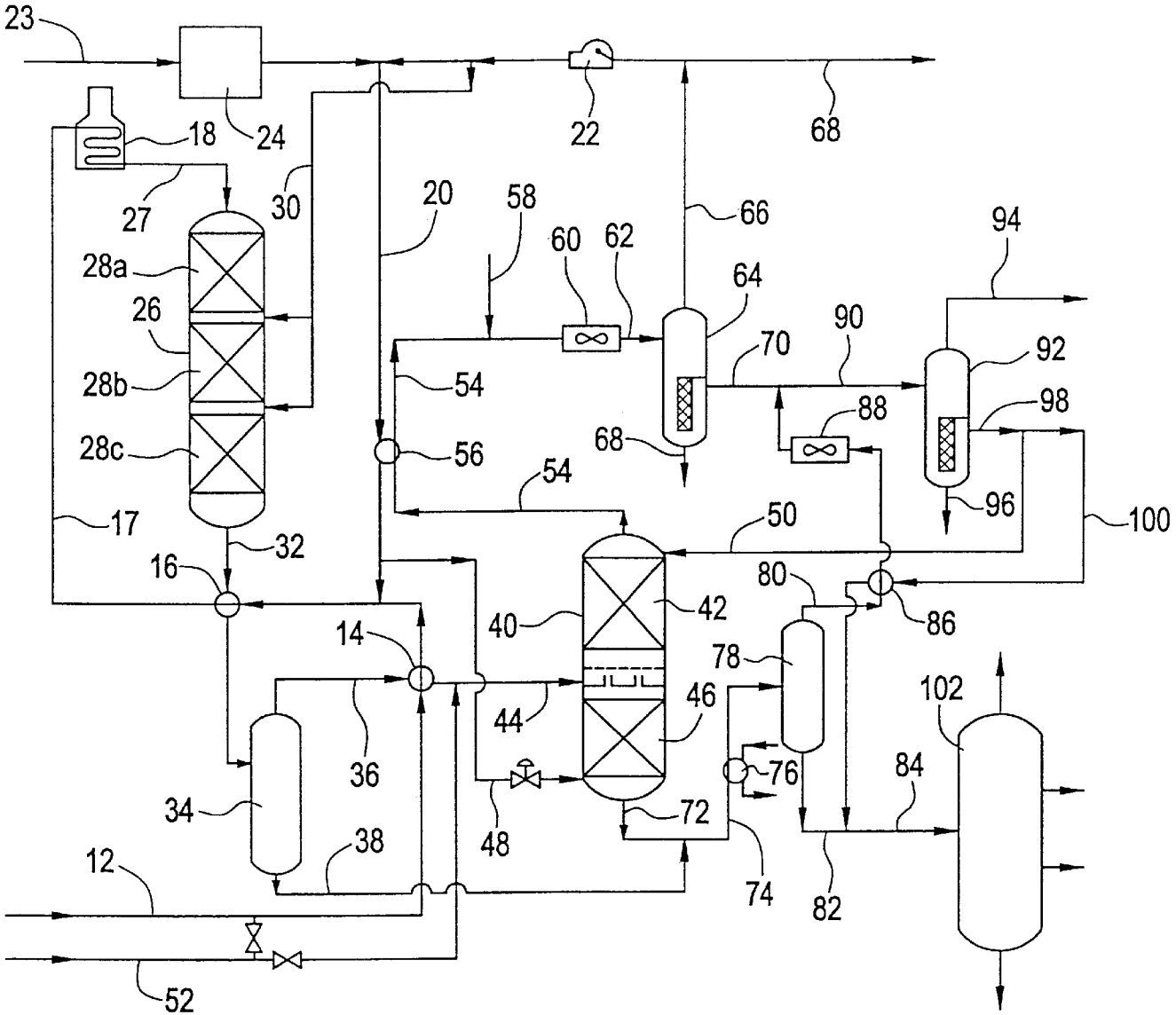
100
92
98
94
96
86
102
84
68
90
88
82
80
76
66
64
70
50
78
74
42
46
72
62
68
22
60
54
40
44
48
58
54
56
20
14
36
38
30
32
24
18
16
34
52
27
28a
26
28b
28c
17
12
23

HYDROCRACKING OF VACUUM GAS AND OTHER OILS USING A POST-TREATMENT REACTIVE DISTILLATION SYSTEM

BACKGROUND OF THE INVENTION

The invention relates to the hydrocracking of vacuum gas oil or various other typical hydrocracking feedstock oils or mixtures thereof.

In hydrocracking technology, reactor operating conditions are dictated either by product quality requirements or by catalyst life. It is impossible to optimize processing conditions in a single reactor because operating conditions in the reactor are set by the most difficult components of the feed. For example, the conditions in the reactor could be set by the amount of nitrogen in the feed. Typically, in the first reactor treating raw feed, conditions are severe (high-temperature) and not conducive to aromatic saturation. Moreover, once products are formed from hydrocracking reactions, they compete with the heaviest fractions of the feed (nominally 700° F.+ material) to gain access to the active catalyst sites. Occlusion of the products (700° F.− material) from the active sites by the heavy products is very likely.

Consequently, for a given conversion level, single reactor systems operating at the same pressure levels as multi-reactor systems produce inferior quality products. In order to compensate for this shortfall in product quality, units are run at higher pressures and with lower space velocities. In most cases, there is considerable giveaway in product quality for at least one major product especially at start-of-run conditions, as operators select an operating pressure level to guarantee the quality of all products and extend the catalyst run length. For example, the hydrocracked Jet/Kerosene Smoke Point is often 30 mm at start-of-run when the specification requires 20 mm. Similarly, the hydrocracked Diesel Cetane Index is often around 60 when the required value is 50. This product quality giveaway translates to a waste of hydrogen. In most refineries, hydrogen is an expensive commodity.

SUMMARY OF THE INVENTION

The present invention relates to a hydrocracking and hydrotreating process which minimizes hydrogen consumption and reduces the overall reactor and catalyst volumes for a given level of performance for the production of diesel oil and lighter materials including kerosene and naphtha. The process provides a first hydrogenation reaction which is limited to the hydrogenation level needed for hydrotreating the feed for the reduction of sulfur and nitrogen and for aromatic saturation and for the hydrocracking to form the diesel and lighter materials. The uncracked heavy fraction that does not require hydrogenation beyond the sulfur and nitrogen removal and aromatic saturation is separated and bypassed around a second, post-treatment hydrogenation in which only the diesel and lighter materials are further hydrogenated thereby reducing the hydrogen consumption. The objects of the invention are accomplished through the use of a main catalytic reactor operating at conditions which produce an effluent of hydrocracked oil and uncracked heavy oil followed by an intermediate vapor/liquid separator and a post-treatment reactor involving reactive distillation for final hydrocracking and hydrotreating. The primary reaction achieves a partial level of conversion without meeting final product quality with the post-treatment reaction operating to hydrogenate only the separated distillates to meet final product specifications. The invention also allows for advantageous feed locations for certain specific feed materials.

BRIEF DESCRIPTION OF THE DRAWING

The drawing is a process flow diagram illustrating the invention.

DESCRIPTION OF THE PREFERRED EMBODIMENT

The invention relates to the hydrocracking and hydrotreating of various oils from distillation or from solvent extraction nominally boiling between 600 or 700° F. up to about 1500° F. In particular, the invention relates to the hydrocracking and hydrotreating of vacuum gas oil or various other known feedstock oils typically processed by hydrocracking such as light cycle oil, coker gas oil, visbreaker gas oil and deasphalted oil. Typically, vacuum gas oil forms the bulk of the feed usually with some quantity of one or more of the other oils. By way of explanation, vacuum gas oil is that fraction of the crude oil that typically boils between about 600° F. and 1200° F. and is derived by the vacuum distillation of residue from the atmospheric distillation column in a petroleum refinery. Depending on the crude source and the boiling range, the composition of paraffins, naphthenes and aromatics and the level of contaminants like sulfur, nitrogen, metals, asphaltenes, etc. can vary widely. Vacuum gas oil is the primary component of feedstock to conversion units such as hydrocracking. A typical vacuum gas oil has the following properties:

Specific Gravity: 0.85 to 0.98

Total Nitrogen, ppm: 100 to 5000

Total Sulfur, ppm: 0.1 to 4.0

Metals (Ni+V), ppm: 0.1 to 2

Distillation range: 600° F. to 1200° F.

Light cycle oil is the light distillate obtained from fluid catalytic cracking of vacuum gas oil in a petroleum refinery. The typical boiling range is 400° F. to 800° F. Light cycle oil is a highly aromatic compound (40–90 wt. % aromatics) and is also high in sulfur. Visbreaker gas oil is the distillate obtained after the fractionation of products obtained from thermally cracking vacuum residue in a visbreaking process. It is high in olefins, nitrogen and sulfur. The typical boiling range is 600° F. to 1000° F. Deasphalted oil is obtained after solvent extraction of the vacuum residue fraction of crude oil in a solvent deasphalting unit. The solvent is typically propane, butane or pentane, and the deasphalted oil is high in metals, nitrogen and sulfur. The typical boiling range is 900° F. to 1500° F.

Referring to the flow diagram of the drawing, a preheated feed 12 of vacuum gas oil and/or other typical hydrocracking feedstock oils, such as coker gas oil and visbreaker gas oil, is fed through and further heated in the heat exchangers 14 and 16 and then fed at 17 to the feed heater 18 in admixture with the hydrogen-rich gas from line 20. The hydrogen-rich gas in line 20 is the hydrogen-rich recycle from the compressor 22 and the make-up hydrogen 23 from the compressor 24.

The mixture of feed oil and hydrogen is fed from the feed heater 18 to the top of the main reactor 26. The main reactor 26 is a cocurrent, downflow reactor containing a plurality of catalyst beds 28*a*, 28*b* and 28*c*. Although three beds have been illustrated, there could be more or less for any particular operating situation. The catalyst may be any hydrogenation catalyst such as those from the following list:

Nickel-molybdenum on alumina

Nickel-molybdenum on silica-alumina with zeolites

Paladium/alumina/zeolite

Nickel/tungsten/titanium silica-alumina with zeolites

Nickel/tungsten on zeolite
Cobalt-molybdenum on alumina
Cobalt-molybdenum on zeolite
The catalyst metals may be impregnated, co-gelled or co-mulled on the base.

In the main reactor 26, the feed is hydrogenated in the presence of the catalyst to hydrotreat for the removal of sulfur and nitrogen compounds and for the saturation of aromatics and to upgrade the feed oils by hydrocracking to produce the lighter products. Although the bulk of the hydrotreating and hydrocracking reactions occur in the main reactor, conditions are maintained including a reduced hydrogen partial pressure and/or a high space velocity whereby fairly high conversions are still achieved but without expending the large quantities of hydrogen which would otherwise be required to fully hydrogenate the heavy oils and to meet the final quality required for the diesel and lighter distillate products. The space velocity may be as much as 15% higher or the hydrogen partial pressure as much as 20% lower or some combination of these changes as compared to a conventional hydrogenation process.

In the main reactor 26, the heated hydrogen/feed mixture 27 flows down through each of the beds 28*a*, 28*b* and 28*c* in series with additional hydrogen 30, preferably from the recycle compressor 22 as shown, being added between the beds to quench and maintain the hydrogen partial pressure. For a typical light vacuum gas oil feed with a feed rate of 35,000 barrels per day and containing 800 ppm nitrogen and 2.3 weight percent sulfur, a typical example of the operating conditions within the main reactor 26 are as follows:

| | |
|---|---|
| $H_2$-rich gas with feed | range 50–300 million standard $ft^3$/day<br>typical 175 million standard $ft^3$/day |
| Recycle quench gas | range 0–200 million standard $ft^3$/day<br>typical 105 million standard $ft^3$/day |
| Make-up hydrogen | range 10–70 million standard $ft^3$/day<br>typical 30 million standard $ft^3$/day |
| Weighted average bed temperature | range 550 to 800° F.<br>typical 730° F. |
| Operating pressure | range 1000 to 3500 psig<br>typical 1900 psig |

Exiting the bottom of the main reactor 26 is the partially hydrogenated intermediate product stream 32 which now contains hydrogen sulfide, ammonia, some excess hydrogen, uncracked heavy hydrotreated oil having a nominal 700° F.+ boiling point, and the hydrocracked product diesel and lighter materials having a nominal 700° F.− boiling point. This product stream 32 passes through the heat exchanger 16 to transfer heat to the incoming feed stream 17. The partially hydrogenated intermediate product stream 32 is flashed in the hot, high-pressure separator 34 to vaporize and recover the majority of the distillates (diesel fuel, kerosene, naphtha) as overhead 36. In the example, the hot separator operates at a temperature of about 600 to 800° F. and a pressure in the range of 1,000–3,500 psig. The temperature in the hot separator 34 is regulated to minimize the vaporization of unconverted oil in the overhead. The heavy product oil effluent 38 from the bottom of the hot separator 34 is the unconverted portion of the feed oil. Although this is basically an unconverted oil, it has undergone hydrodenitrification and hydrodesulfurization and also a substantial amount of aromatic saturation. One of the features of the invention is that the amount of hydrogen used by the heavy oil product is minimized. This is done by bypassing the heavy product oil effluent 38 around the portion of the active catalyst in the post-treatment reactor 40. The heavy product oil effluent 38 may later be combined with the overall product as will be described or it may be separately processed.

The overhead 36 from the hot separator 34 is fed as stream 44 to the post-treatment reactor 40. The post-treatment reactor 40 contains an upper bed 42 above the feed 44 and a lower bed 46 below the feed. The feed is primarily a mixture of vapor with some condensate. Hydrogen 48 is fed to the bottom of the post-treatment reactor and flows up through both beds. A small quantity of cold reflux 50 is added to the top of the post-treatment reactor as a cooling quench and to wash down any unconverted oil. The upper bed 42 is a hydrogenation catalyst bed. The vapor fraction of the feed 44, essentially the diesel and lighter materials, flows up through the bed 42 in contact with the hydrogen flowing up in a cocurrent manner to complete the hydrogenation of these products. In the bottom bed 46., the liquid portion of the feed, essentially entrained unconverted oil from the hot separator with some diesel and perhaps lighter material, is stripped of the diesel and lighter material by the hydrogen moving up through the bed counter-current to the liquid flowing down. Depending on the degree of post treatment required for any particular situation, the bottom bed 46 can be packed with either a highly efficient inert structural packing for stripping or with an active hydrotreating catalyst for reactive stripping. If it is required to meet the post treatment reactor requirements, the vapor 44 from the hot separator 34 can be cooled by heat exchange at 14 against the main reactor feed 12. As a further alternative, if light cycle oil 52 obtained from the fluid catalytic cracking of vacuum gas is a desired feed component, it is preferably fed to the process after the hot separator 34 and prior to the post-treatment reactor 40 because it can cause rapid catalyst deactivation. However, it can also be fed to the main reactor 26 along with the other oils. Following up on the specific operating conditions previously recited, a specific example of the operating conditions in the post-treatment reactor 40 are as follows:

Average bed temperature
  range 500 to 750° F.
  typical 675° F.
Operating pressure
  range 1000 to 3500 psig
  typical 1900 psig
Hydrogen feed (48)
  range 2 to 30 million standard $ft^3$/day
  typical 9 million standard $ft^3$/day The vapor effluent 54 from the post-treatment reactor 40 contains the diesel and lighter distillate products along with the remaining hydrogen and the hydrogen sulfide and ammonia from the sulfur and nitrogen removed from the feed. The effluent 54 is partially cooled by heat exchange at 56 against the hydrogen feed 20. The partially cooled stream 54 is then injected with water at 58 to prevent the deposition of ammonium bisulfide that may form when the reactor effluent is being cooled. The partially cooled effluent stream 54 is then cooled further at 60 to condense the product hydrocarbons, such as the diesel oil, kerosene and naphtha, leaving the hydrogen and some lighter hydrocarbons as vapor. The stream 62 is now a three-phase mixture of gases, liquid hydrocarbon and an aqueous phase. These three phases are separated in the cold high-pressure separator 64 with the hydrogen-rich gaseous phase 66 forming the recycle to the recycle compressor 22 and with the sour water phase being discharged at 68. The liquid hydrocarbon phase is discharged at 70.

Returning now to the post-treatment reactor 40, the bottoms 72 containing primarily unconverted oil is combined with the unconverted oil 38 from the bottom of the hot separator 34. This combined stream 74 is cooled at 76 to recover heat by heating other process streams in this unit. Then the unconverted oil is flashed in the hot low-pressure separator 78 to recover light gases and hydrogen. The bottoms 82 from the hot low-pressure separator 78 form a portion of the combined product stream 84. The vapor stream 80 from the hot low-pressure separator 78 is partially cooled at 86 and then further cooled at 88 and combined with the hydrocarbon effluent 70 from the cold high-pressure separator 64. This forms the stream 90 which again is a three-phase stream which is separated at 92 to form the vapor stream 94, the sour water stream 96 and the hydrocarbon product stream 98. The vapor stream 94 containing some hydrogen is sent for recovery of that hydrogen and any other desired constituents.

A portion of the hydrocarbon product stream 98 is withdrawn to form the reflux 50 to the post-treatment reactor 40. The remaining hydrocarbon product stream 100 passes through the heat exchanger 86 and is combined with the unconverted oil stream 82. The total product stream 84 is then sent for separation, such as in the generally designated distillation system 102, into the various components such as diesel oil, kerosene, naphtha and unconverted oil.

In the present invention, two distinct reactor stages, the main reactor and the post-treatment reactor, are combined with an intermediate vapor/liquid separation to reduce the overall catalyst volume, the reactor weight, the hydrogen consumption, the product quality giveaway and to increase the process flexibility. The first or main reactor stage is operated at conditions including the hydrogen level and space velocity whereby the unconverted oil is only treated to the level necessary to meet the quality requirements such as saturation of aromatics and hydrodesulfurization and hydrodenitrification. Essentially all of the hydrotreating and most of the hydrocracking takes place in this first reactor. The unconverted oil then bypasses the post-treatment reactor in which the hydrocracking of the distillates is completed to the extent required to meet the final product specifications. This selective addition of hydrogen, as opposed to the addition of all of the hydrogen in a single reactor under non-optimum conditions, leads to a significant reduction in hydrogen consumption, perhaps by 5–30%. Further, the operating pressures can be lowered for the same catalyst volume, perhaps by about 5–30%, or the catalyst volume can be lowered by about 5–30% at the same operating pressure.

In the invention, the heaviest portion of the feed that contains the bulk of the sulfur and nitrogen, is hydrotreated only to the extent necessary and is then separated so that it does not come into contact with the portion of the catalyst in the post-treatment reactor which would otherwise be deactivated at a higher rate.

What is claimed is:

1. A method of hydrocracking and hydrotreating a hydrocracking feedstock oil selected from the group consisting of vacuum gas oil, light cycle oil, coker gas oil, visbreaker gas oil, deasphalted oil and mixtures thereof containing sulfur and nitrogen and aromatics for the production of distillates comprising diesel oil, kerosene and naphtha comprising the steps of:

a. providing a first reactor containing a hydrogenating catalyst;

b. heating said hydrocracking feedstock oil to a desired catalytic hydrotreating and hydrocracking temperature;

c. passing said heated hydrocracking feedstock oil and a quantity of hydrogen down through said first reactor under conditions whereby said hydrocracking feedstock oil is hydrodesulfurized and hydrodenitrified and said aromatics are substantially saturated and whereby the first reactor effluent bottoms contains both hydrocracked oil and uncracked heavy oil;

d. flashing said first reactor effluent bottoms thereby producing hydrocracked oil vapors and liquid uncracked heavy oil;

e. separating said hydrocracked oil vapors from said liquid uncracked heavy oil;

f. cooling said hydrocracked oil vapors and forming a mixture of hydrocracked oil vapors and hydrocracked oil condensate;

g. providing a second reactor which is a catalytic distillation reactor containing at least one hydrogenating catalyst bed;

h. introducing said mixture and additional hydrogen into said second reactor and into contact with said catalyst bed whereby said hydrocracked oil is further hydrotreated to form said distillates; and i. removing a hydrogen-rich gas stream from said distillate and recycling said hydrogen-rich gas stream to said first reactor.

2. A method as recited in claim 1 wherein said first reactor contains a plurality of catalyst beds and wherein said quantity of hydrogen in said first reactor is sufficient to maintain a hydrogen partial pressure and includes the introduction of a hydrogen-rich gas quench between said plurality of catalyst beds.

3. A method as recited in claim 1 and further including the step of feeding a light cycle oil feedstock to said second reactor.

4. A method as recited in claim 1 wherein said hydrocracking feedstock oil has a boiling range above 700° F. and wherein said hydrocracked oil has a boiling range less than 700° F. and said uncracked heavy oil has a boiling range above 700° F.

* * * * *